US006845769B2

(12) United States Patent
Chen

(10) Patent No.: US 6,845,769 B2
(45) Date of Patent: Jan. 25, 2005

(54) FOLDABLE CONDUCTIVE OVEN (III)

(76) Inventor: Gao-Shan Chen, No. 2, Alley 492, Hai Tian Rd., Sec. 2, Tainan (TW)

( * ) Notice: Subject to any disclaimer, the term of this patent is extended or adjusted under 35 U.S.C. 154(b) by 0 days.

(21) Appl. No.: 10/446,844

(22) Filed: May 29, 2003

(65) Prior Publication Data

US 2004/0020482 A1 Feb. 5, 2004

(30) Foreign Application Priority Data

Aug. 1, 2002 (TW) ..... 91212089 U

(51) Int. Cl.[7] ..... A47J 37/00
(52) U.S. Cl. ..... 126/9 R; 126/25 R
(58) Field of Search ..... 126/9 R, 9 A, 126/9 B, 25 R, 29, 30, 40, 38

(56) References Cited

U.S. PATENT DOCUMENTS 677,176 A * 6/1901 Cochran ..... 126/9 R
3,109,420 A * 11/1963 Ott et al. ..... 126/9 R
3,146,773 A * 9/1964 Melzer ..... 126/9 R
4,211,206 A * 7/1980 Darbo ..... 126/9 R
4,508,096 A * 4/1985 Slattery ..... 126/9 R
4,971,045 A * 11/1990 Probst ..... 126/65

* cited by examiner

*Primary Examiner*—James C. Yeung

(57) ABSTRACT

A foldable conductive oven comprises a pedestal, a pedestal comprises two opposite outward plates, two opposite outward cover plates and a box. The framework comprises two opposite inner cover plates, two opposite inner plates, and a frame. When unfold the foldable conductive oven, the round prominent pellets on the two outward plates and the two outward cover plates, which are against the locational holes on the box and the locational holes on the frame, are used to fasten the foldable conductive oven. The foldable conductive oven provides convenience and practicability, because the invention is able to be folded or unfolded without any tools and easy to be carried or picked up.

4 Claims, 6 Drawing Sheets

FOLDABLE CONDUCTIVE OVEN (III)

BACKGROUND OF THE INVENTION

The present invention relates to a conductive oven, and more particularly to a foldable conductive oven which is folded or unfolded quickly without any tools and easy to be carried or picked up.

A conventional conductive oven isn't foldable without tools and the space is always wasted because of the large volume of a conventional conductive oven.

SUMMARY OF THE INVENTION

A foldable conductive oven comprises a pedestal, a framework, an ash-collecting box, a grill and a net.

The pedestal comprises two opposite outward plates, two opposite outward cover plates and a box. The framework comprises two opposite inner cover plates, two opposite inner plates, and a frame.

When unfold the foldable conductive oven, the round prominent pellets on the two outward plates and the two outward cover plates, which are against the locational holes on the box and the locational holes on the frame, are used to fasten the foldable conductive oven. The foldable conductive oven provides convenience and practicability, because the invention is able to be folded or unfolded without any tools and easy to be carried or picked up.

DETAILED DESCRIPTION OF THE INVENTION

Figure 1:
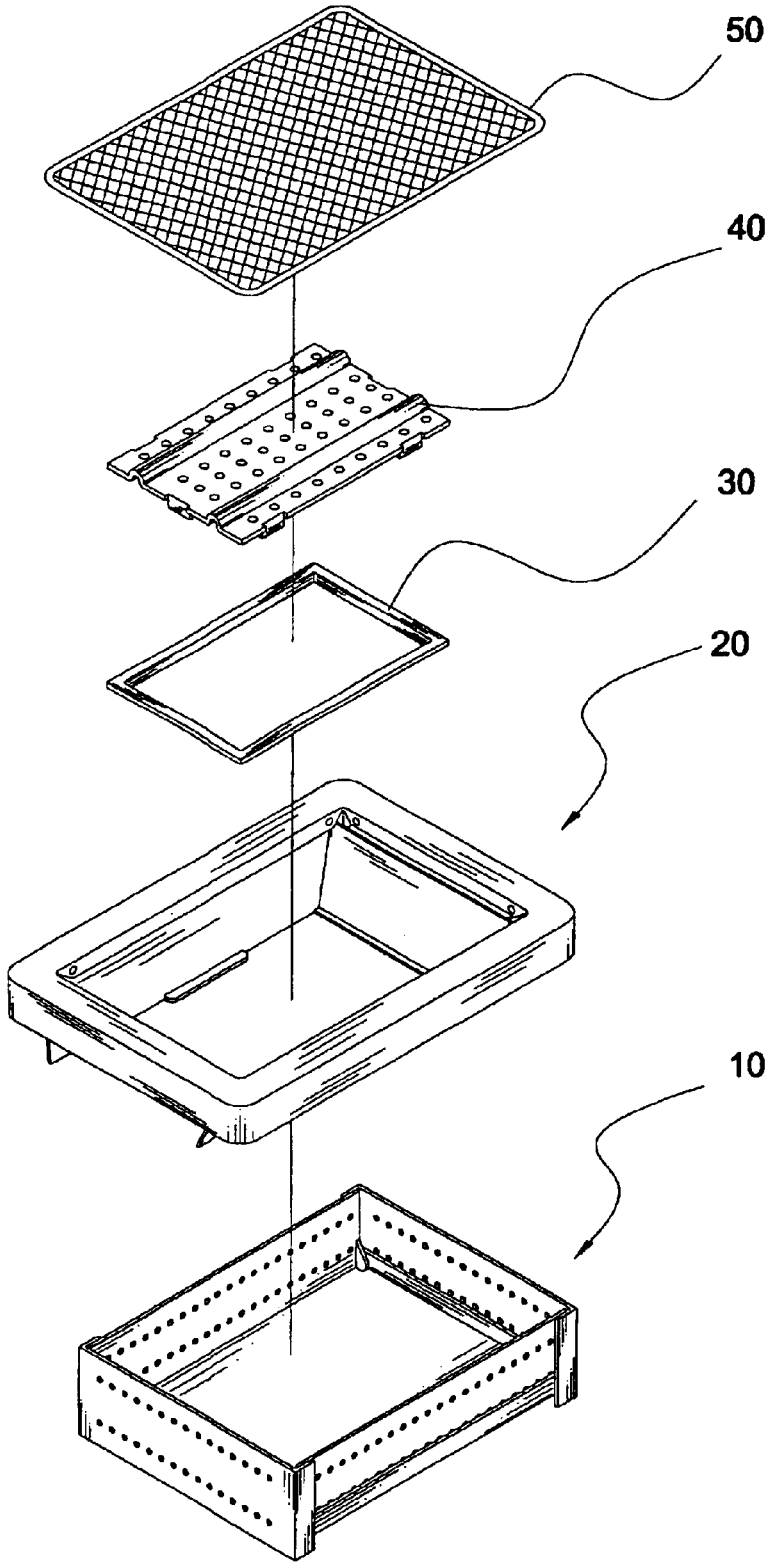
FIG. 1 is a perspective exploded view of a foldable conductive oven in accordance with this invention.

Referring to FIG. 1, the foldable conductive oven 1 comprises a pedestal 10, a framework 20, an ash-collecting box 30, a grill 40 and a net 50.

Figure 2:
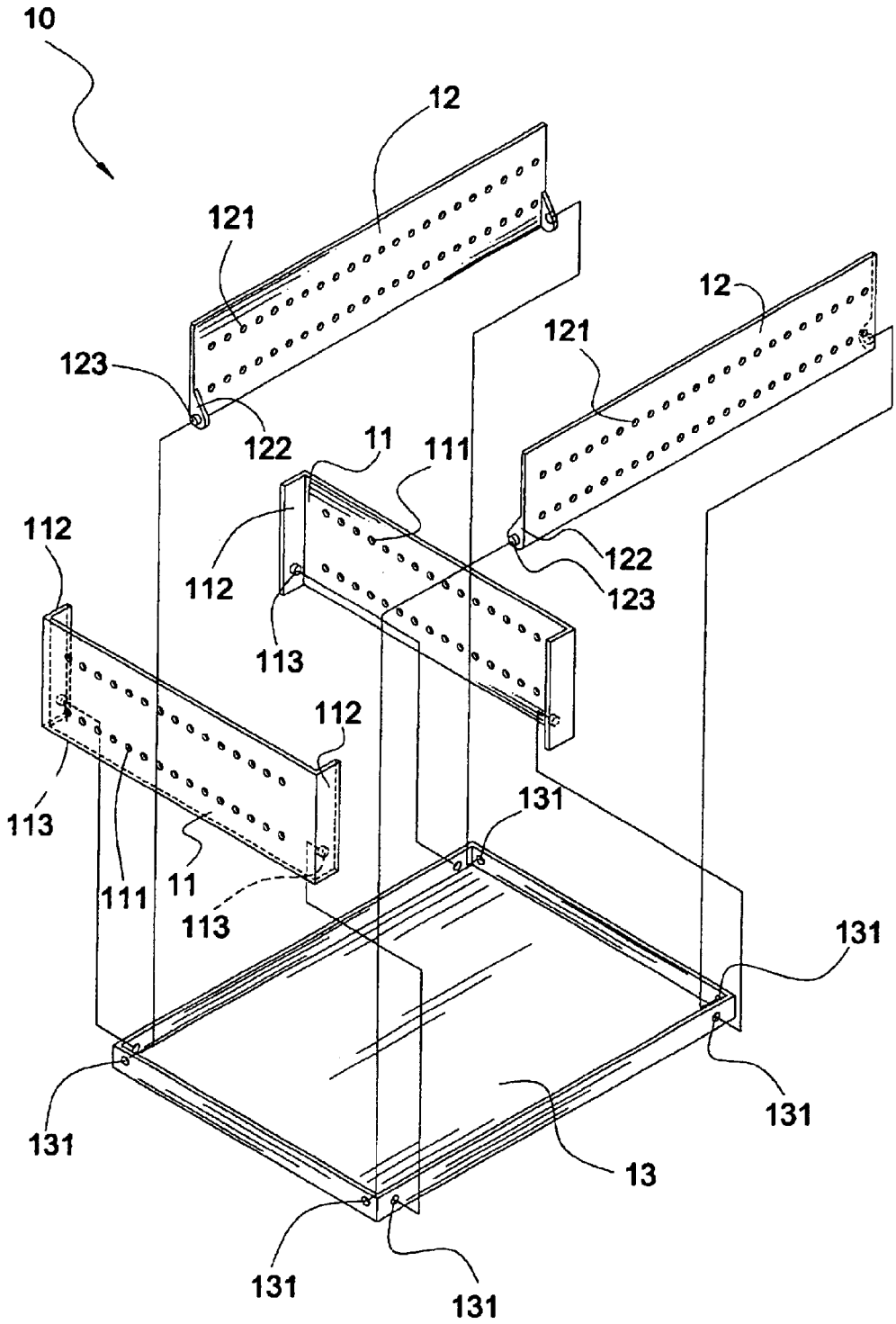
FIG. 2 is a perspective exploded view of a pedestal of a foldable conductive oven in accordance with this invention.

Referring to FIG. 2, the pedestal 10 comprises two opposite outward plates 11, two opposite outward cover plates 12 and a box 13.

The each outward plate 11 has a lot of holes 111, two opposite side edges 112 on two ends and one round prominent pellet 113 on lower end of the one side edge 112.

The each outward cover plate 12 has a lot of holes 121, two opposite lugs 122 on the bottom and one round prominent pellet 123 on the one lug 122.

The box 13 has eight locational holes 131 to correspond the four round prominent pellets 113, which are on the four side edges 112 of the two outward plates 11, and the four round prominent pellets 123, which are on the four lugs 122 of the two outward cover plates 12; the eight locational holes 131 are able to be wedged into the four round prominent pellets 113, which are on the two outward plates 11, and the four round prominent pellets 123, which are on the two outward cover plates 12. Then the two outward plates 11 and the two outward cover plates 12 are able to be folded on the box 13.

Figure 3:
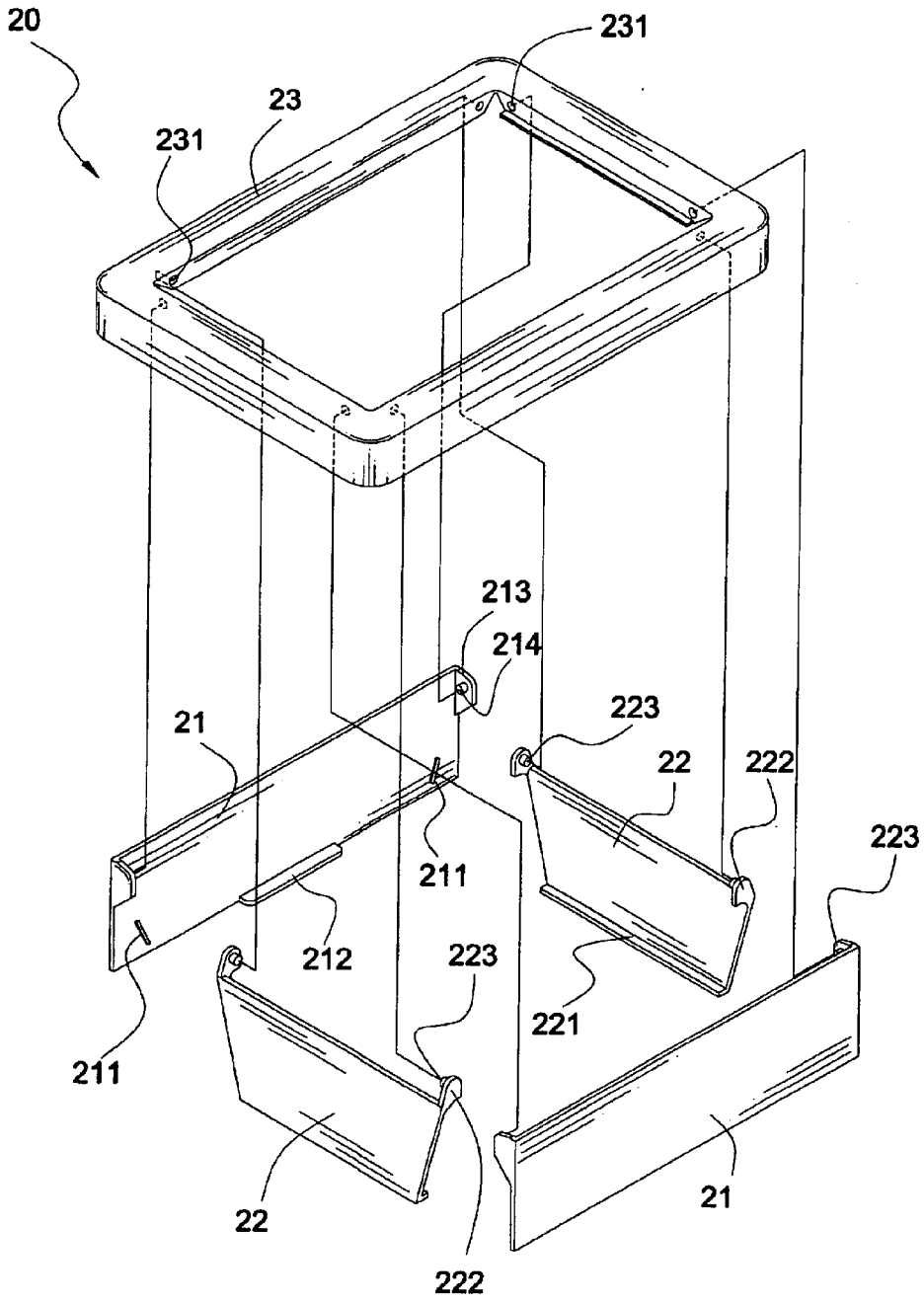
FIG. 3 is a perspective exploded view of a framework of a foldable conductive oven in accordance with this invention.

Referring to FIG. 3, the framework 20 comprises two opposite inner plates 22, two opposite inner cover plates 21 and a frame 23.

The each inner plate 22 has a prominent piece 221, two opposite lugs 222 on the two ends and one round prominent pellet 223 on the one lug 222.

The each inner cover plate 21 has two blockers 211, a prominent piece 212 and two opposite lugs 213 on the two ends, one round prominent pellet 214 on the one lug 213.

The frame 23 has eight locational holes 231 to correspond the four round prominent pellets 223, which are on the four lugs 222 of the two inner plates 22, and the four round prominent pellets 214, which are on the four lugs 213 of the two inner cover plates 21; the eight locational holes 231 are able to be wedged into the four round prominent pellets 223, which are on the two inner plates 22, and the four round prominent pellets 214, which are on the two inner cover plates 21; the lockers 211 are used to support the two inner plates 22. Then the two inner plates 22 and the two inner cover plates 21 are able to be folded on the frame 23.

Figure 4:
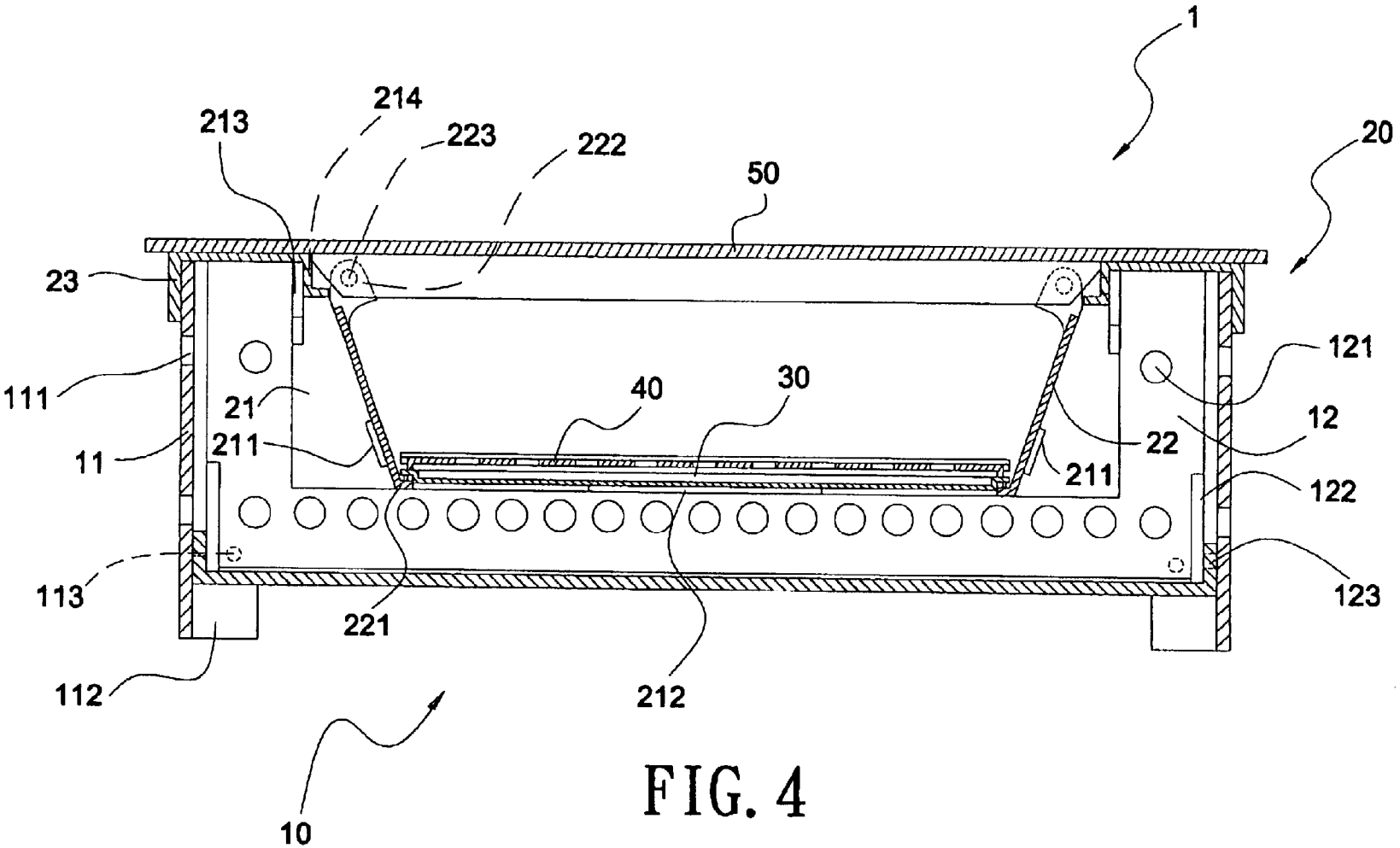
FIG. 4 is a cutaway assembly view of a foldable conductive oven in accordance with this invention.

Referring to FIG. 4, in assembly, the framework 20 is connected with the pedestal 10 by the structures of the two outward plates 11 and the two outward cover plates 12.

The ash-collecting box 30 is put on the two prominent pieces 212 of the two inner cover plates 21 and the two prominent pieces 221 of the two inner plates 22.

The grill 40 is put on the ash-collecting box 30.

The net 50 is put on the surface of the framework 20.

Figure 5:
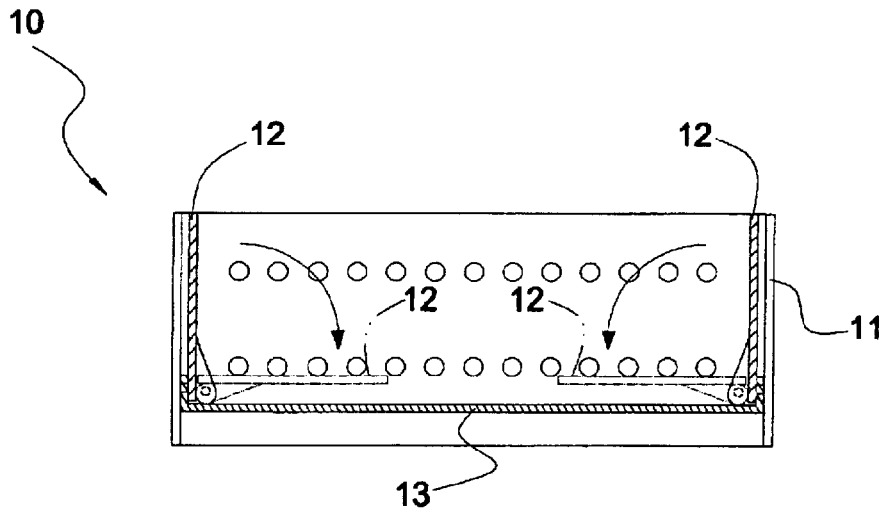
FIG. 5 is an operate diagram of a folded pedestal of a foldable conductive oven in accordance with this invention.
Figure 6:
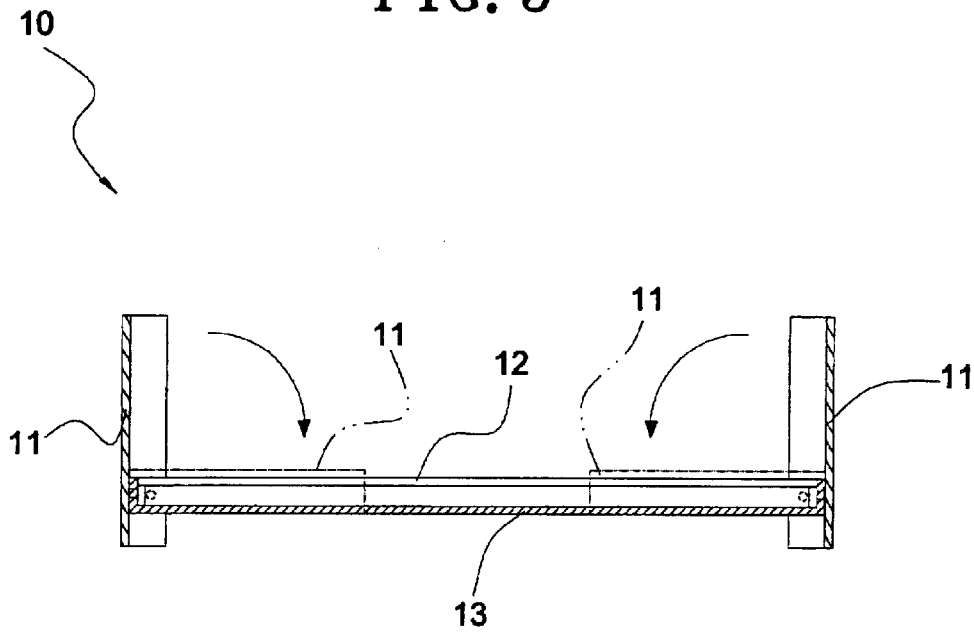
FIG. 6 is another operate diagram of a folded pedestal of a foldable conductive oven in accordance with this invention.

Referring to FIGS. 5 to 6, the two outward cover plates 12 are folded first and next the two outward plates 11 are folded to fold the pedestal 10 completely.

Figure 7:
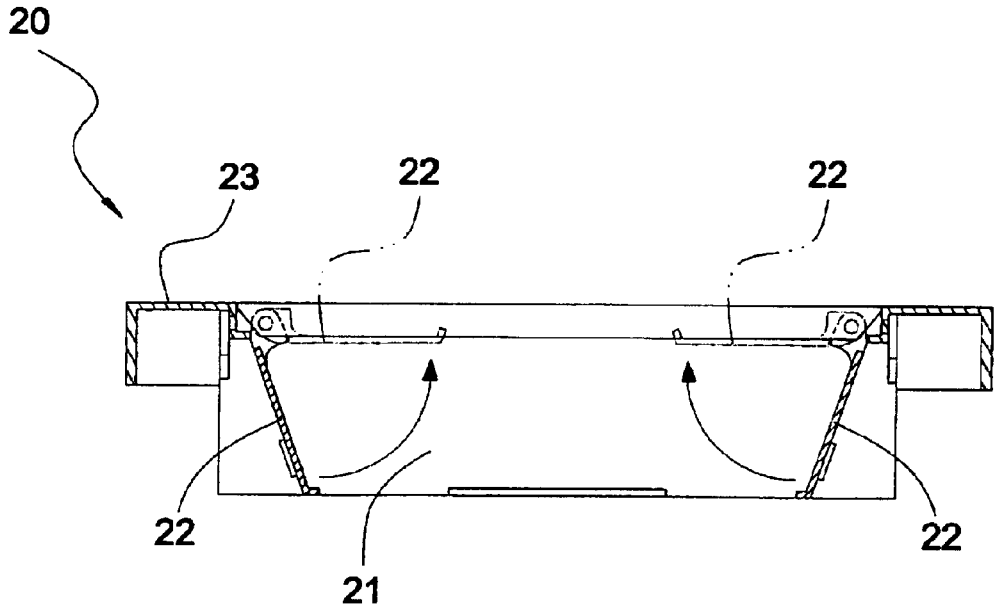
FIG. 7 is an operate diagram of a folded framework of a foldable conductive oven in accordance with this invention.
Figure 8:
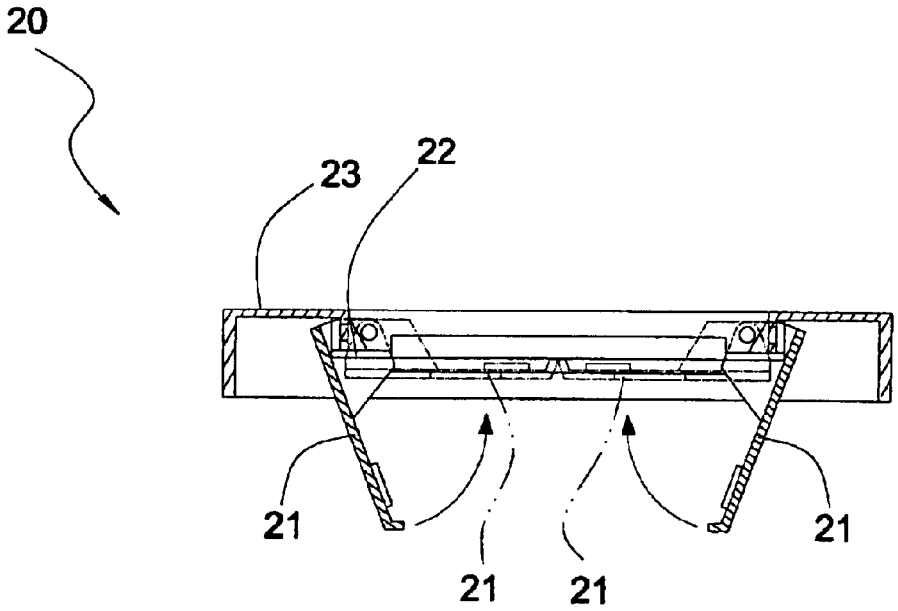
FIG. 8 is another operate diagram of a folded framework of a foldable conductive oven in accordance with this invention.

Referring to FIGS. 7 to 8, the two inner plates 22 are folded first and next the two inner cover plates 21 are folded to fold the framework 20 completely.

I claim:

1. A foldable conductive oven comprising in the assembled condition:

a pedestal comprises two opposite outward plates, two opposite outward cover plates and a box;

each outward plates has a plurality of holes, two opposite side edges on two ends and one round prominent pellet on a lower end of the one side edge, each outward cover plate has a plurality of holes, two opposite lugs on a bottom and one round prominent pellet on each of the lugs, and the box has eight location holes to correspond to the four round prominent pellets which are on the four side edges of the two outward plates, and the four round prominent pellets, which are on the four lugs of the two outward cover plates, a framework comprises two opposite inner plates, two opposite inner cover plates and a frame;

each of the inner plates has a prominent piece, two opposite lugs on a side and one round prominent pellet on each of the lugs, each of the inner cover plates has two blockers, a prominent piece and two opposite lugs on a side, one round prominent pellets on each of the lugs, and the frame has eight location holes to correspond to the four round prominent pellets which are on the four lugs of the two inner plates, and the four prominent pellets, which are on the four lugs of the two outward cover plates, an ash-collecting box;

a grill; and a net.

2. A foldable conductive oven of claim 1, where said eight location holes on said box are able to be wedges into said four round prominent pellets, which are on the two outward plates, and said four round prominent pellets, which are on said two outward cover plates, whereby said two outward plates and said two outward cover plates are able to be foldable on said box.

3. A foldable conductive cover of claim 1, wherein said eight location holes on said frame are able to be wedged into said four round prominent pellets, which are on said two inner pellets, and said four round prominent pellets, which are on said two inner cover plates, whereby said two inner plates and two said inner cover plates are able to be folded on said frame.

4. A foldable conductive oven of claim 1, wherein said framework is put on a top of said pedestal; said ash-collecting box is put on a top of the framework; said grill is put on a top of the ash-collecting grill; and said net is put on a top of the grill.

* * * * *